United States Patent [19]

Rehder

[11] 4,179,283

[45] Dec. 18, 1979

[54] PRODUCTION OF METALS

[76] Inventor: John E. Rehder, 36 Castle Frank Rd., Apt. 309, Toronto, Ontario, Canada

[21] Appl. No.: 888,027

[22] Filed: Mar. 20, 1978

[30] Foreign Application Priority Data

| | | | |
|---|---|---|---|
| Mar. 21, 1977 | [GB] | United Kingdom | 11872/77 |
| Jul. 13, 1977 | [GB] | United Kingdom | 29376/77 |
| Jul. 13, 1977 | [GB] | United Kingdom | 29377/77 |

[51] Int. Cl.[2] ..... C22B 1/08; C22B 1/24

[52] U.S. Cl. ..... 75/40; 75/3; 75/4; 75/42; 75/43

[58] Field of Search ..... 75/40, 3, 4, 42, 43

[56] References Cited

U.S. PATENT DOCUMENTS

| | | | |
|---|---|---|---|
| 3,156,557 | 11/1964 | Dahl | 75/3 |
| 3,702,182 | 11/1972 | Leyshon | 75/43 |
| 4,062,673 | 12/1977 | Roberts | 75/40 |

*Primary Examiner*—P. D. Rosenberg

*Attorney, Agent, or Firm*—Sim & McBurney

[57] ABSTRACT

Metals are formed from metal oxides in a shaft furnace, by reduction using powdered carbon in pellets, such pellets also including additional powdered carbon for combustion under controlled conditions in the presence of oxygen to achieve the temperature required in the shaft furnace for the reduction reaction and to form molten metal and slag.

10 Claims, No Drawings

PRODUCTION OF METALS

BACKGROUND OF THE INVENTION

It is well known that when a pulverized metal oxide, such as hematite, is mixed with pulverized carbon and the mixture is heated, the oxide will be reduced to metal and, if the temperature is high enough, the metal and associated gangue will be melted to form molten metal and slag. Known processes perform such heat treatment in shaft furnaces fueled by the combustion of carbon added as raw coal or as lump coke.

In the former case, for example, Worner, U.S. Pat. No. 3,652,069 issued March 1972, the metal oxide is mixed with raw coal in excess of that necessary for reduction, and the volatile matter in the coal is driven off in the upper part of the shaft to form a low-temperature coke. The excess coke descends with the charge to tuyere level near the base of the shaft where it is burned with cold or hot air. In the latter case, as in Obenchain, U.S. Pat. No. 3,832,158 issued Aug. 27, 1974, pellets made of a mixture of metal oxide and carbon are charged in layers alternating with layers of lump coke, the coke being burned near tuyere level with cold or hot air.

The difficulties with the use of a raw coal as in Worner are in controlling the carbonization or devolatilization in the upper part of the stack, in condensation of tar in the top of the furnace and in gas offtakes, and the fact that the coke so formed is a low temperature variety which burns at low combustion efficiency and resulting high consumption of carbon. A coking coal is also necessary. The difficulties with the case of lump coke as specified by Obenchain are the necessity to use expensive lump coke as fuel, the layered type of charge distribution, and lack of definition of conditions of combustion except to describe the combination as utilizing "air through tuyeres as in a blast furnace".

The most important part of such processes is the combustion of carbon to provide heat, which should be done at maximum combustion efficiency, i.e. maximum content of carbon dioxide in final products of combustion, and should use low cost forms of carbon. This requires the specification of both the conditions of combustion and of the type or nature of the carbon being burned, but this is not done in either of the patents quoted nor in other known patents involving combustion in solid carbon fueled shaft furnaces.

SUMMARY OF INVENTION

In accordance with the present invention, fine grained, low volatile, non-coking forms of carbon are used for combustion purposes under controlled conditions to smelt metal oxides efficiently in a shaft furnace. The ability of use such forms of carbon for combustion considerably decreases the cost of smelting, since expensive coke and the steps required to form the same are avoided, and also considerably improves the environmental aspects of smelting, since coal and its associated volatile material are avoided.

The present invention is particularly directed to the reduction of iron oxides to form iron but the principles thereof may be used for the reduction of other metal oxides to the appropriate metal using powdered carbon.

The iron oxide may be in the form of an ore or concentrate, or present in waste materials from steel plant processing, including mill scale, blast furnace dust, open hearth dust, and electric furnace dust.

GENERAL DESCRIPTION OF INVENTION

The cupola widely used as a simple melter of solid charge materials, and the blast furnace, widely used as a smelter performing both reduction of metal oxides and the melting of resulting metal and gangue, are structurally very similar. Both are refractory lined shafts with a row of tuyeres near the base for entry of combustion air, charge materials being introduced at the top and molten metal and slag being withdrawn through tap-holes below the tuyere level, fuel carbon being lump coke.

However, the functional differences between the cupola and the blast furnace require quite different conditions of combustion in the two types of furnace, and coke that is well adapted to use in the blast furnace is known to give poor economy in the cupola. The necessity in the blast furnace for generating carbon monoxide as a reducing agent sharply limits the amount of heat released and the flame temperature of combustion. Typically, the gas rising a foot or two above tuyere level in a blast furnace will contain 35 percent carbon monoxide and negligible carbon dioxide, releasing about 4,350 btu per pound of carbon burned. In a correctly operated cupola this gas will contain about 6.5 percent carbon monoxide and 17 percent carbon dioxide, releasing about 11,700 btu per pound of carbon burned or about 2.7 times the heat release in blast furnace combustion. There is an associated increase in the flame temperature of combustion in the cupola.

In the reduction of compacts of mixed metal oxide and carbon and the melting of resulting metal and slag only heat is required, at maximum practicable efficiency for economy, so that the cupola mode of combustion in a shaft furnace furnace is preferred and is used in this invention.

The present invention achieves a high efficiency of metal oxide reduction by controlling the conditions of entry of combustion air to the shaft furnace and the type and form of carbon utilized for combustion. The conditions of entry of combustion air used in this invention to achieve high efficiency are such that no raceway or void is formed in front of a tuyere and that the space velocity of combustion air referred to the empty shaft at normal temperature and pressure (STP) be greater than about 200 feet per minute, preferably about 300 to 350 feet per minute.

Absence of a raceway requires limiting the mass flow rate and the velocity of air through each tuyere so that thrust is less than about 15 pounds. As the space velocity of air in the shaft is decreased, the zone of high temperature combustion is shortened and is lower in maximum temperature. Blast furnaces conventionally operate with raceways three feet or more in length, and space velocity of combustion air in the range 120 to 160 feet per minute.

A secondary reaction takes place in the conventional cupola above the zone of maximum carbon dioxide development, whereby part of the rising carbon dioxide is reduced by descending coke to form carbon monoxide. This reaction absorbs heat which decreases stock column temperature, and consumes carbon uselessly, so for economy must be limited in extent as far as possible. This is usually done by using fuel coke of low reactivity, of large lump size to decrease the specific surface area, and high space velocity of gases to limit the time of contact between gases and coke. Good cupola mode of combustion with a coke fuel of low reactivity charged as four to five inch lumps will give top gases containing about 10 percent carbon monoxide and 15 percent carbon dioxide, with net heat development of about 10,490 btu per pound of carbon burned, or about 2.4 times the heat developed in the blast furnace mode of combustion. If, however, a high reactivity carbon such as a bituminous coal char is used in cupola mode combustion, the top gases will contain about 22 percent carbon monoxide and 8 percent carbon dioxide, developing only 7,000 btu per pound of carbon burned.

The properties of carbon suited for use as a fuel to be burned with maximum combustion efficiency are therefore low reactivity to carbon dioxide and low specific surface. These are directly opposed to the properties of carbon suited for maximum reduction rate within metal oxide-carbon compacts, which are well known to be high reactivity and large specific surface.

For the purposes of this specification, the reactivity of carbon is defined as the percent weight loss when a 2 gram minus 200 mesh sample of the carbon, previously devolatilized at 1,000° C., is placed in a refractory boat in a horizontal tube furnace maintained at 1000° C., and pure carbon dioxide is passed through the tube at the rate of 50 milliliters per minute for one hour. A good foundry cupola coke will show 15 percent loss or less in this test, whereas a char from a bituminous coal which would be a good reductant would show 45 percent loss.

Typical high reactivity carbons are charcoal, lignite char, and low to moderate temperature cokes from bituminous coal. Low reactivity carbons include high temperature cokes from bituminous coal, anthracite coals particularly at low volatile matter content, some petroleum cokes, and some natural graphites. Caking or coking properties are independent and are unnecessary for the purposes of this invention. It is important that carbon for reduction or combustion be low in volatile matter content, preferably below 15 percent, to avoid difficulty with tar and distillation products in the top of the furnace and in gas cleaning equipment, and also to permit accurate knowledge and control of the amount of fixed carbon being effective for reduction and for combustion.

In the present invention, metallic oxide-carbon compacts for reduction and efficient combustion in a shaft furnace to be operated under the conditions defined above use two types of carbon. One type of carbon is in an amount and of high reactivity and specific surface area for reduction primarily, and the other type is of low reactivity and specific surface area for efficient combustion. With respect to the carbon intended for combustion, being incorporated in a larger mass such as a compact decreases the effective specific surface area accessible to exterior gases containing carbon dioxide, and so the rate of undesirable oxidation of carbon by carbon dioxide is decreased.

In a preferred embodiment of the invention, the compacts are formed first of a mixture of finely divided metal oxide and high reactivity carbon in an amount for complete reduction only, and then each compact is coated with a layer of low reactivity, coarse grained carbon in the amount necessary for combustion. Loss of carbon by reduction by carbon dioxide in the upper part of the shaft is decreased to a minimum by this procedure, the high reactivity reduction carbon is physically protected by the outer layer until it descends far enough in the stack to reduce the metal oxide, and the low reactivity carbon is combusted at good efficiency.

An added advantage of keeping the two types of carbon separate in this preferred embodiment of the invention is that it is then practicable to make various additions to affect the reactivity of the two types of carbon independently. For example, it is well known that salts of the alkali metals such as sodium, potassium or lithium when added to carbon increase its reactivity, and so such salts can be added to the innner oxide-carbon mixture where high reactivity is desirable for rapid reduction, and kept out of contact with the outer layer carbon to be combusted with low reactivity. Alternatively, a single type of carbon may be used in both portions, with reactivity-increasing additives being made to the inner oxide-carbon mixture but not to the carbon to be combusted.

In the compacts used in this invention, either with both types of carbon mixed or with the lower reactivity carbon as a shell, the lower reactivity carbon should be as coarse grained as permitted by practical conditions in making a compact of sufficient mechanical strength. The higher reactivity carbon and the metal oxide to be reduced should be as finely divided as economically practical in order to promote a rapid reduction rate. The size of the compacts charged to the furnace generally should be not less than about two inches in diameter considered as spheres, and preferably about four to about seven inches in diameter, in order to obtain low ratio of surface to volume for minimum loss of carbon by reduction of carbon dioxide. The compact shape should generally approach spherical for the same reason, and also to obtain high void percentage and bulk permeability in the burden as a whole. Binder systems for compacts include portland cement, lime-silica-autoclave, and asphalts or pitches. Suitable fluxes to produce slag of satisfactory quality are readily incorporated in the mixture from which the compact is made.

In this invention, the sole charge material to the shaft furnace consists of compacts containing metal oxide, reduction carbon and combustion carbon, along with fluxes and binder. This procedure removes the need for layering of separate charge materials, and the relatively large desired size of the compacts will give a charge column that is of low resistance to gas flow.

A decrease in the amount of combustion carbon necessary can be made by the well known practice of preheating combustion air. The use of combustion air that is preheated or enriched in oxygen also increases flame temperature so that more refractory oxides than iron oxide, such as those of manganese and chromium, can be reduced at good recoveries. These practices, when adopted, should be used at the lower or primary row of tuyeres only, since high flame temperatures are undesirable at the upper tuyeres, as described below.

During the reduction of metal oxide in an oxide-carbon compact a considerable quantity of carbon monoxide is released, which becomes part of the rising stream of products of combustion in the shaft, reaching 35 to 50 percent in volume. This gas can be burned by air introduced through one or more rows of tuyeres above the primary row, as is well known. It is important, however, when such combustion is effected during the process of the invention, to arrange secondary rows of tuyeres at heights above the primary row, and their air supplies in volumes, such that carbon monoxide can be burned at rates and at flame temperatures such that no premature melting or sticking of compacts is done, and the heat developed can be absorbed by the solid charge material where the heat requirement created by the reduction reaction is greatest. In one embodiment of the invention, the air supplies to each row of tuyeres are maintained independent and controllable so that the amount and rate of heat release at each row can be controlled. As an example, in a 90 inch diameter shaft furnace being operated in accordance with this invention, a second row of tuyeres generally is located about 4 to 12 feet above the primary row, and the air supply to the secondary row amounts to about 20 to 50 percent of that entering the primary row of tuyeres.

It is not considered practical to burn by such means all of the carbon monoxide in the rising gas stream available, due to limitations on air penetration into the stock column and the increasing complexity of supplying and controlling multiple rows of tuyeres. Furthermore, each level of combustion of carbon monoxide creates above itself a temperature zone in which the rate of reduction of accompanying carbon dioxide is increased, with resultant loss of carbon. Calculation indicates that the maximum net recovery of heat involves the combustion of not more than about 50 to 65 percent of the carbon monoxide available when smelting.

The flame temperature developed on combustion of carbon monoxide by auxiliary tuyeres may be limited and controlled by diluting the combustion air so that its oxygen content is below normal. A convenient source of low oxygen content diluent gas for such purpose is top gas from the same shaft. The oxygen content of diluted combustion air controls the flame temperature developed, and the volume of contained oxygen determines the number of heat units developed, thereby giving very good control over the intensity and amount of heat generated by burning carbon monoxide.

By the use of preheated combustion air in the primary row of tuyeres, and combustion of part of the carbon monoxide in stack gases, the amount of combustion carbon necessary can be decreased, so that, when the practices are used, the mixture for a self-reducing self-combusting compact to make iron typically contains about 100 parts by weight of hematite, about 18 to 20 parts of reduction carbon, and about 15 to 20 parts of combustion carbon. The total carbon then required per ton of molten iron made is about 940 to 1,140 pounds of non-coking carbon fines, as compared with current good blast furnace practice of about 1,000 pounds of carbon as metallurgical lump coke.

Since the shaft furnace in this invention is operated in the cupola-like mode of combustion, the shaft furnace also may be used as an efficient melter of metallic charge materials. Metallic materials, therefore, may be charged, if desired, along with oxide-carbon compacts, provided extra fuel in appropriate amount is added for melting such metallic materials. The heat required for simple melting and superheating of iron is only about 20 to 25 percent of that required for smelting iron to the same tapping temperature, so only about 20 to 25 percent as much combustion carbon need be added per ton of iron produced. This proportionately increases the rate of production of a shaft furnace per square foot of cross section per day, typically being 20 to 25 net tons for simple melting and 4 to 6 tons for smelting.

The extra combustion carbon for melting metallics may be added as lump coke but preferably is added as increased combustion carbon in the oxide-carbon compacts. The ability to operate in this manner is of particular value in iron foundry operation where returns and sprue must be remelted along with fresh metal. By using this invention, the fresh metal can readily be formed by reduction of clean low cost iron oxides simultaneous with the remelting of the returns and sprue.

EXAMPLE

Compacts were made of blast furnace dry waste dust containing some carbon and coke breeze, with 6 percent by weight of portland cement as binder, the final shapes being pieces 3 to 4 inches thick with irregular circumference of about 18 inches. The iron content of the compacts was 35 percent and the carbon content was 24 percent, i.e., 1,377 pounds of carbon per net ton of iron. The compacts were charged to a cupola 40 inches inside diameter which had just completed an 8 hour run melting iron and whose refractories were still hot. The cupola had two rows of tuyeres 36 inches apart through which 2,000 cubic feet per minute of air at ambient temperature were blown, approximately half through each row of tuyeres. Operation was conducted for one hour, during which iron was smelted and tapped with composition C 4.39 percent, Si 1.96 percent, Mn 1.03 percent, S 0.23 percent, and P 0.30 percent. Considerable slag volume was satisfactorily tapped through a slag hole at the rear of the hearth. The iron and slag tapped were very hot, over 1,600° C., accounting for the high silicon concentration of the iron, and demonstrating that considerably less carbon could have been used for the reduction.

What I claim is:

1. A process for smelting metal oxide to molten metal with improved combustion efficiency, comprising:

forming compacts having a nominal diameter of at least about two inches and consisting essentially of an intimate mixture of metal oxide, solid carbonaceous material, slag material and a binder, the carbon content of said compacts being sufficient for complete reduction of the metal oxide and for combustion, the solid carbonaceous material used for combustion having a volatile matter content of less than about 15% by weight;

charging said compacts to a shaft furnace;

burning said solid carbonaceous material used for combustion in said compacts by air introduced through primary tuyeres near the base of the shaft primarily to carbon dioxide;

controlling the mass flow rate and velocity of air through each tuyere to provide a maximum thrust of air at each primary tuyere to a value of less than 15 pounds, whereby no raceway or cavity is formed at any tuyere, and a space velocity of the combustion air in the furnace referred to the empty shaft at normal temperature and pressure (STP) of greater than 200 feet per minute, reducing said metal oxide to the corresponding metal under the influence of the heat generated by said combustion using the portion of said solid carbonaceous material in said compacts not used for said combustion; and withdrawing the resulting molten metal and slag from the shaft furnace.

2. The process of claim 1, wherein said solid carbonaceous material used for combustion is provided as an external layer on each compact.

3. The process of claim 1, wherein said solid carbonaceous material used for combustion has a reactivity to carbon dioxide of less than 20.

4. The process of claim 2 wherein said solid carbonaceous material present as said external layer has a reactivity to carbon dioxide of less than 20, and said solid carbonaceous material used for reduction of said metal carbide has high reactivity to carbon dioxide and a high specific surface area.

5. The process of claim 1 including burning part of the carbon monoxide developed by the combustion and reduction reactions by a free oxygen-containing gas introduced to auxiliary tuyeres located above said primary tuyeres in said shaft furnace from a source of air dependent of the air supply to the primary tuyeres.

6. The process of claim 5, wherein said auxiliary tuyeres are located about 4 to about 12 feet above said primary tuyeres.

7. The process of claim 6, including diluting air from said source for said auxiliary tuyeres with a gas having a low free oxygen content to provide an overall free oxygen content in the gas introduced through the auxiliary tuyeres which is less than air.

8. The process of claim 7, wherein said low free oxygen gas comprises top gas from the shaft furnace.

9. The process of claim 2 wherein said compacts have a nominal diameter of about 4 to about 7 inches.

10. The process of claim 1 including charging metal for remelting to the shaft furnace along with the compacts and introducing additional amounts of carbon to the shaft furnace for combustion to melt said charged metal.

* * * * *